United States Patent [19]

Polansky et al.

[11] Patent Number: 4,692,216

[45] Date of Patent: Sep. 8, 1987

[54] METHOD FOR CONTROLLING HEAT INPUT INTO A COKE OVEN

[75] Inventors: Jon L. Polansky; Douglas N. Rice, both of Penn Hills Township, Allegheny County; William J. Tomcanin, Penn Township, Westmoreland County, all of Pa.; Timothy B. Cribbs, Baytown, Tex.

[73] Assignee: United States Steel Corporation, Pittsburgh, Pa.

[21] Appl. No.: 544,925

[22] Filed: Oct. 24, 1983

[51] Int. Cl.[4] ..... C01B 47/00

[52] U.S. Cl. ..... 201/1; 202/151; 364/557; 364/571

[58] Field of Search ..... 201/1, 41; 202/151; 364/557, 571

[56] References Cited

U.S. PATENT DOCUMENTS

| | | | |
|---|---|---|---|
| 2,510,158 | 6/1950 | Van Ackeren | 241/41 |
| 3,085,582 | 4/1963 | Slosman et al. | 134/57 |
| 3,501,380 | 3/1970 | Perch | 201/1 |
| 3,556,947 | 1/1971 | Kumper | 201/1 |
| 3,607,660 | 9/1971 | Kumper | 201/1 |
| 4,003,803 | 1/1977 | Schmidt-Balve | 202/262 |
| 4,021,309 | 5/1977 | Radstake et al. | 202/227 |
| 4,045,292 | 8/1977 | Matsushita et al. | 201/1 |
| 4,064,017 | 12/1977 | Beck et al. | 201/1 |
| 4,090,945 | 5/1978 | Reeves | 208/11 R |

FOREIGN PATENT DOCUMENTS

| | | | |
|---|---|---|---|
| 2460125 | 12/1974 | Fed. Rep. of Germany . | |
| 1411263 | 10/1975 | Fed. Rep. of Germany . | |
| 894529 | 11/1983 | France | 201/1 |
| 57-159877 | 10/1982 | Japan | 201/1 |

OTHER PUBLICATIONS

"Computerized Investigation of Temperature Distributions in Coke-Oven Chambers" by Butorin and Matveeva, 1975.

"Evaluation of Improved Silica Ovens at Emil Plant of Bergbau-Forschung GMBH" by Rohde, Stalherm and Beck, Ironmaking Proceeding vol. 34 (Toronto) 1975, pp. 177-192.

"Heat Measurement of Coking Coals" by Perch and Bridgewater, Iron and Steel Engineer, Jul., 1980, pp. 47-50.

"Armco's Newest Research Lab: Coal is the Name of the Game", 33 Metal Producing, Jul., 1980, pp. 56-58.

"Dofasco Fine Tunes its Cokemaking Act with Feed Forward Combustion Control", 33 Metal Producing, Jul., 1980, pp. 64-65.

"Fast-Reading Calorimeter Improves Combustion, Saves Energy", Iron and Steel Engineer, Feb., 1981.

*Primary Examiner*—Tim Miles

*Attorney, Agent, or Firm*—George D. Dickos

[57] ABSTRACT

Method of controlling heat input into a coke oven to obtain a desired temperature of the coke mass of the oven at the time of pushing comprising (1) determine the moisture content and heat of carbonization of a sample of coal scheduled for transfer into the oven; (2) determine a coal mass, a target coking time, and an efficiency for said oven; (3) calculate the heat requirement and temperature of the coke mass during the coking operation of the coke oven based upon the coal moisture, the heat of carbonization, the coal mass, the target coking time, and the efficiency; (4) determine the temperature of the coke mass during the coking operation; (5) compare the temperature determined from step (4) with the calculated temperature based upon the calculation of step (3); (6) analyze any deviations noted in step (5) to obtain a more accurate heat requirement for said oven, and (7) vary the heat input into said oven in accordance with the more accurate heat requirement.

This method preferably also includes the following additional steps: (1) compare a target temperature of the coke mass with the calculated temperature; (2) analyze the deviations of the target temperature from the calculated temperature, and (3) vary the heat input in response to the deviations.

20 Claims, 3 Drawing Figures

METHOD FOR CONTROLLING HEAT INPUT INTO A COKE OVEN

FIELD OF THE INVENTION

This invention relates to a method of controlling the heat input into a coke oven/coke battery, and preferably by means of a computer.

BACKGROUND OF THE INVENTION

Present manual efforts to control heat input into a coke oven require the operator to observe trends in the coke temperature as the coke is pushed, via visual determination and occasionally by hand-held pyrometer measurement. The operator is then expected to increase or decrease the heat input to the battery as required by changes in coal composition, battery operating rate, and underfiring gas composition. The inability of the operator to anticipate and make accurate underfiring adjustments results in increased fuel usage, decreased coke quality and decreased battery life.

Because of the problems with manual control systems, considerable effort has been put into automating the control of heat input into coke ovens. For example, U.S. Pat. No. 4,045,292, incorporated herein by reference, teaches a system for controlling combustion in a coke oven battery by setting a target flue temperature on the basis of details of the coal charge in order to achieve a target net coking time and a target soaking time given by a coke production schedule. The actual flue temperature is then measured and deviations from the target flue temperature are determined to set a flow rate and calorific value of the fuel gas for each oven group, and a corresponding stack draft for each oven group. The target flue temperature is then bias corrected based on the measured flue temperature, measured net coking times, measured soaking times and the details of the corresponding coal charge.

However, the system of U.S. Pat. No. 4,045,292 requires a large amount of instrumentation and related wiring to determine by indirect measurement the amount of heat needed by the oven. This tends to increase the risk of error. Such an instrumentation and wiring intensive system is very susceptible to malfunction. Such malfunction could naturally lead to expensive errors in control of heat input, expensive plant closedowns for repair, decreased coke quality, and decreased battery life.

SUMMARY OF THE INVENTION

This invention relates to a method of controlling heat input into a coke oven to obtain a desired temperature of the coke mass of the oven at the time of pushing comprising (1) determine the moisture content and heat of carbonization requirement of a sample of coal scheduled for transfer into the oven; (2) determine a coal mass, a target coking time, and an efficiency for said oven; (3) calculate the heat requirement and temperature of the coke mass during the coking operation of the coke oven based upon the coal moisture, the heat of carbonization, the coal mass, the target coking time, preferably the underfiring history, and the efficiency; (4) determine the temperature of the coke mass during or at the completion of the coking operation; (5) compare the temperature determined from step (4) with the calculated temperature based upon the calculation of step (3); (6) analyze any deviations noted in step (5) to obtain a more accurate heat requirement for said oven, and (7) vary the heat input into said oven in accordance with the more accurate heat requirement.

This method preferably also includes the following additional steps: (1) compare a target temperature of the coke mass with the calculated temperature; (2) analyze the deviations of the target temperature from the calculated temperature, and (3) vary the heat input in response to the deviations.

BRIEF DESCRIPTION OF THE DRAWINGS

This invention is illustrated by the following drawings.

DESCRIPTION OF THE DRAWINGS AND PREFERRED EMBODIMENT(S)

This invention uses occasional measurements of coke temperature (preferably via a hand-held pyrometer or an infrared sensor mounted on the guide car) to adjust a feedforward computer-prediction of battery heat requirements from measurements of coal sample parameters and oven efficiencies. Because these coal parameters are sampled before the coal is charged into the battery, the magnitude and direction of heat requirement variations is anticipated, and the underfiring rate for the battery is regulated accordingly.

To determine these coal parameters, a coal sample, taken from coal-handling facilities, is measured to determine the coal mass, and a portion of this sample is placed into one of two coal coking calorimeters. Each calorimeter furnace consists of two concentric heater coils with individual temperature controllers, a cylindrical retort into which the coal is charged, and instrumentation necessary to monitor temperature distributions and the energy input to the furnace. Preferably a computer calculates the energy required to coke a unit weight of the coal sample, and enters this heat-of-carbonization value along with the bulk density measurement in the coal inventory table under a run identification number. The coal inventory program maintains a record in this table for all the coal runs to the bunker, and a periodic bunker level measurement is used to monitor the coal flow to the bunker and into the ovens. The coal flow to each oven is recorded in a separate oven contents table, and the heat requirement for each oven is calculated. Occasional coke temperature feedback measurements are compared with the expected coke temperatures which are calculated. As trends are detected in these temperature deviations, the oven requirement calculation is tuned in order to obtain more accurate predictions.

A weighted average of the oven requirements is calculated and this battery heat requirement is used with the measured Wobbe index of the fuel gas to calculate a gas flow setpoint and a corresponding stack draft setpoint. Finally, the gas flow control and the draft control regulate the battery operation about these setpoints so as to achieve efficient underfiring combustion.

Figure 1:
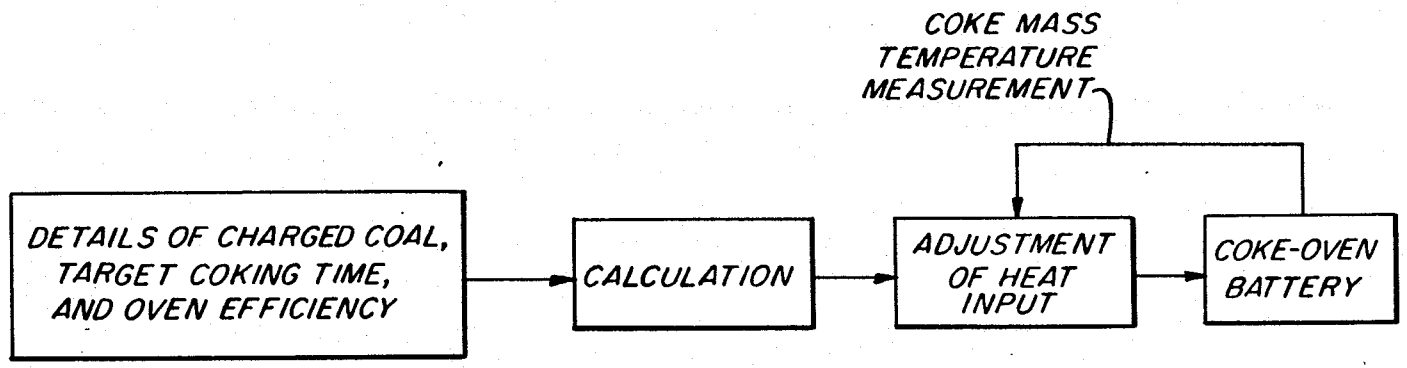
FIG. 1 is a block diagram showing the method of controlling the heat input into a coke oven battery.

In FIG. 1 the block diagram shows one embodiment of the scheme for controlling the heat input into a coke oven. Details of the charged coal, target coking time, and oven efficiency provide means for calculating the heat requirement and temperature of the coke mass during coking operation. A coke mass temperature measurement is made which is then compared with the calculated value. Adjustments to the heat input are then made based on the difference noted in the calculated and measured values.

Figure 2:
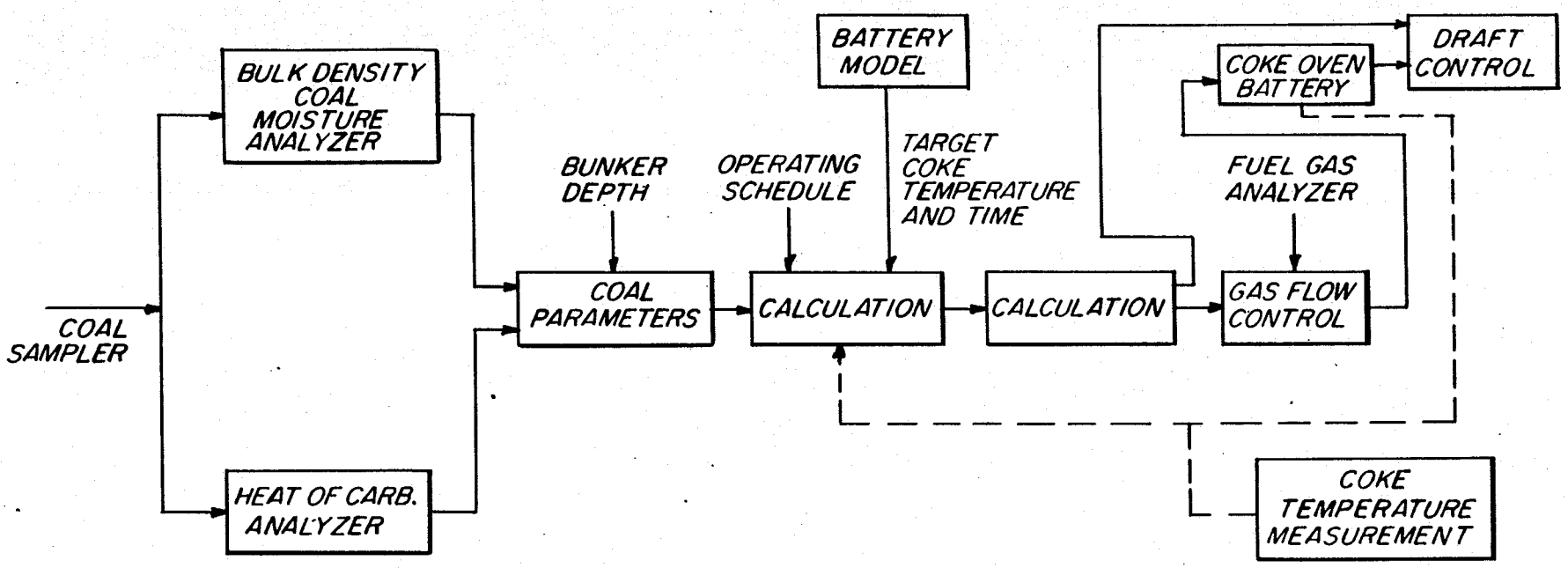
FIGS. 2 and 3 are block diagrams showing preferred methods of controlling the heat input into a coke oven battery.

In FIG. 2 an automatic coal sampler 1 provides samples to a bulk density and coal moisture analyzer 2 and a heat of carbonization analyzer 3. These are combined with input relative to the bunker depth 4 to provide coal parameter 5 which are combined with information concerning operating schedule 6, the battery model 7 involving oven efficiency, target coke temperature and target coking time to determine the heat requirement and coke temperature 8 during the coking operation. This is combined with information from the fuel gas analyzer 9 to calculate a gas flow rate 10 which is used to control gas flow 11 and/or draft 12 for the coke oven battery 13. The actual coking temperature measurement 14 provides a comparison with that calculated in 8 to make further adjustments to the coke oven battery heat input.

Figure 3:
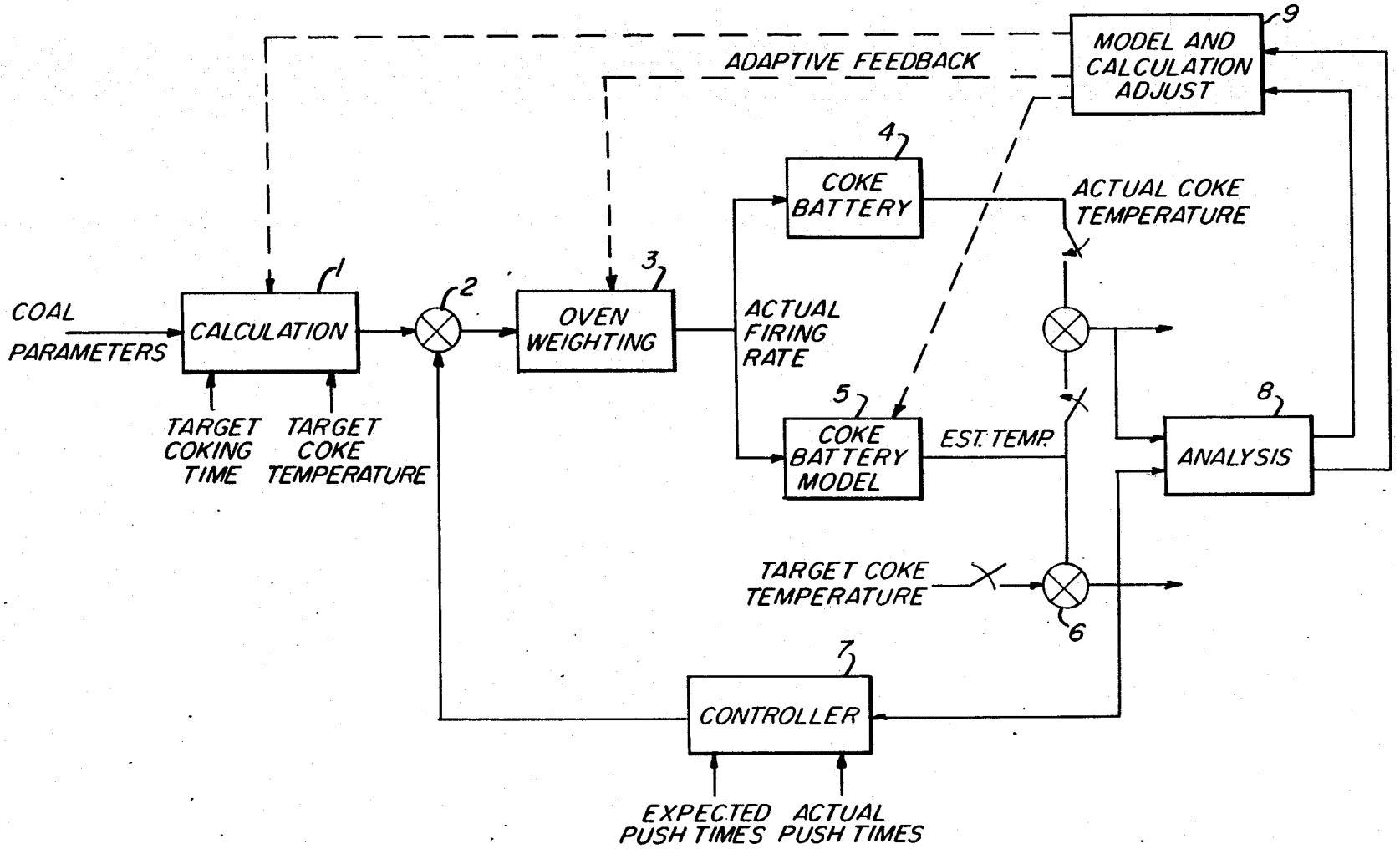

In FIG. 3, the block diagram shows a preferred method of information flow and calculations required to achieve closed loop control of the cokemaking process. Measurements of coal parameters, such as heat of carbonization, moisture content, bulk density, and ambient temperature, are combined with desired values of end point coke temperature and coking time to compute an initial estimate at 1 of the heat input required by the coke battery. This heat input is then weighted at 3 according to individual efficiencies of each oven comprising the coke battery to obtain a revised estimate of the required coke battery heat input. This revised heat is then applied to the coke battery 4 via manipulation of combustion parameters such as fuel and combustion air. The revised heat input value, along with the previously mentioned measurements of coal parameters are used to provide inputs to a suitable dynamic mathematical thermochemical model 5 of the coking process (such as that developed by V. I. Butorin and G. N. Matveeva of the Magnitogorsk Mining and Metallurgical Institute, USSR) to provide occasional estimates of the thermal state of the coke mass and coke oven temperature distribution. These estimates are compared at 6 against the desired coke temperature to generate a difference which is relayed at 7 to a suitable controller, together with expected completion of coking time (and actual time of pushing when available) to develop at 2 a further refinement of the heat input of the battery such that the values of the parameters approach the desired values. At the completion of each coking cycle, actual coke-mass temperature measurements are made using the most suitable means available, such as hand-held pyrometers or devices mounted on the coke-oven machinery itself, and combined with the estimates provided by the aforementioned mathematical model. The combined data is then analyzed statistically at 8, and the results used to determine at 9 further refinements to the heat input calculation algorithms at 1, the oven weighting algorithm at 3, and the thermochemical model at 5.

Preferably a target temperature of the coke mass during the coking operation is compared with a comparable calculated value; any deviations are analyzed between the two values, and the heat input for the coke oven is varied in response thereto.

Additionally, it is preferred to determine the coke oven heat efficiency and modify the model for calculating the heat requirement and the temperature of the coke mass based upon the comparison of the determined temperature and the calculated temperature, and the target temperature and the calculated temperature.

Additionally, it is preferred to analyze deviations between the target coking time and a measured coking time, and to vary heat input into the coke oven in response to these deviations.

Heat input can be varied by any of the art recognized methods such as varying fuel flow rate, fuel composition, or the amount or quality of combustion air added to the oven.

Preferably the temperature of the oven and coke is measured by using pyrometric instrumentation mounted on a guide car as the coke is being pushed.

The preferred calorimeter for use in this invention has a turn around time of less than one-half hour.

Preferably at least some of the steps of the method of this invention are carried out by computer. More preferably, a major portion of the steps are carried out by computer.

We claim:

1. Method of controlling heat input into a coke oven to obtain a desired temperature of the coke mass of said oven at the time of pushing comprising:

(1) determine the moisture content and heat of carbonization of a sample of coal scheduled for transfer into said oven;

(2) determine a coal mass, a target coking time, and an efficiency for said oven;

(3) calculate the heat requirement and temperature of the coke mass during the coking operation of said coke oven based upon said coal moisture, said heat of carbonization, said coal mass, said target coking time, and said efficiency;

(4) determine the temperature of said coke mass during the coking operation;

(5) compare the temperature determined from step 4 with the calculated temperature based upon the calculation of step (3);

(6) analyze any deviations noted in step (5) to obtain a more accurate heat requirement for said oven, and (7) vary the heat input into said oven in accordance with said more accurate heat requirement.

2. Method as in claim 1 additionally comprising the steps of (1) compare a target temperature of said coke mass with said calculated temperature;

(2) analyze the deviations of said target temperature from said calculated temperature, and (3) vary said heat input in response to said deviations.

3. Method as in claim 2 additionally comprising determining the coke oven heat efficiency and modifying the model for calculating said heat requirement and the temperature of said coke mass based upon the comparison of said determined temperature and said calculated temperature, and said target temperature and said calculated temperature.

4. Method as in claim 2 additionally comprising the steps of (1) compare a target coking time for a coke mass with a measured coking time for such coke mass;

(2) analyze the deviations of said target coking time with said measured coking time, and (3) vary said heat input in response to said deviations.

5. Method as in claim 1 wherein said heat input is varied by varying the flow rate or composition of the fuel added to said oven.

6. Method as in claim 1 wherein said heat input is varied by varying the combustion air added to said oven.

7. Method as in claim 1 wherein the temperature of said coke mass is determined by using pyrometric instrumentation mounted on a guide car as the coke is being pushed.

8. Method as in claim 1 wherein said heat of carbonization is determined by means of a calorimeter that has a turn around time of less than about ½ hour.

9. Method as in claim 1 wherein at least some of the steps are carried out by means of a computer.

10. Method as in claim 3 wherein a major portion of the steps are carried out by means of a computer.

11. Method as in claim 1 wherein said coal mass is determined by measuring the bulk density of the coal mass and the volume of said oven to be filled by said coal mass.

12. Method as in claim 1 wherein said coal mass is determined by weighing.

13. Method of controlling heat input into a coke oven to obtain a desired temperature of coke mass of said oven at the time of pushing comprising:

(1) determine the moisture content and heat of carbonization of a sample of coal scheduled for transfer into said oven;

(2) determine a coal mass by means of a coal bulk density and volume, a target coking time, and an efficiency for said oven;

(3) calculate the heat requirement and temperature of the coke mass during the coking operation of said coke oven based upon said coal moisture, said heat of carbonization, said coal mass, said target coking time, and said efficiency;

(4) determine the temperature of said coke mass during the coking operation;

(5) compare the temperature determined from step (4) with the calculated temperature based upon the calculation of step (3);

(6) analyze any deviations noted in step (5) to obtain a more accurate heat requirement for said oven;

(7) vary the heat input into said oven in accordance with said more accurate heat requirement;

(8) compare a target temperature of said coke mass with said calculated temperature;

(9) analyze the deviations of said target temperature from said calculated temperature;

(10) vary said heat input in response to said deviations of step (9), and

(11) modify the model for calculating said heat requirement for said oven and the temperature of said coke mass based upon the comparison of said determined temperature and said calculated temperature, and said target temperature and said calculated temperature, and wherein the method is carried out by means of a computer.

14. Method as in claim 13 additionally comprising the steps of (1) compare said target coking time for a coke mass with a measured coking time for such coke mass;

(2) analyze the deviations of said target coking time with said measured coking time, and (3) vary said heat input in response to said deviations.

15. Method as in claim 13 wherein said heat input is varied by varying the flow rate or composition of the fuel added to said oven based upon a measured flow rate, measured composition and model showing how changes in either or both of these parameters will change the heat input.

16. Method as in claim 13 wherein said heat input is varied by varying the combustion air added to said oven.

17. Method as in claim 13 wherein the temperature of said coke mass is determined by using pyrometric instrumentation mounted on a guide car as the coke is being pushed, and wherein said calculated and target temperatures are also for this same time.

18. Method as in claim 17 wherein said heat of carbonization is determined by means of a calorimeter that has a turn around time of less than about ½ hour.

19. Method as in claim 13 wherein said efficiency for said oven is determined by averaging the efficiency for the coke oven battery of which said oven is a part.

20. Method as in claim 19 wherein said oven efficiency determined by averaging the coke oven battery efficiency is adjusted to determine individual oven efficiencies by means of the method of claim 13.

* * * * *